US006070558A

United States Patent [19]

Allen et al.

[11] Patent Number: 6,070,558

[45] Date of Patent: Jun. 6, 2000

[54] PROCESS FOR REDUCING LINER LACQUERING IN A MARINE DIESEL ENGINE AND FUEL THEREFOR

[75] Inventors: Robert William Allen, Saltash; Michael James Attfield, Horsham, both of United Kingdom

[73] Assignee: The Lubrizol Corporation, Wickliffe, Ohio

[21] Appl. No.: 08/839,023

[22] Filed: Apr. 23, 1997

[30] Foreign Application Priority Data

Nov. 16, 1994 [GB] United Kingdom ..... 9423259
Nov. 15, 1995 [WO] WIPO ..... PCT/GB95/02682

[51] Int. Cl.[7] ..... F02B 75/12

[52] U.S. Cl. ..... 121/1 A; 44/331

[58] Field of Search ..... 123/1 A; 44/331, 44/412

[56] References Cited

U.S. PATENT DOCUMENTS

| | | | |
|---|---|---|---|
| 4,204,481 | 5/1980 | Malec | 123/1 A |
| 4,227,889 | 10/1980 | Perilstein | 44/56 |
| 4,242,099 | 12/1980 | Malec | 44/53 |
| 4,285,824 | 8/1981 | Bryant . | |
| 4,482,356 | 11/1984 | Hanlon . | |
| 4,489,194 | 12/1984 | Hayashi . | |
| 4,592,761 | 6/1986 | Zaweski et al. . | |
| 4,797,134 | 1/1989 | Vataru . | |
| 5,756,435 | 5/1998 | Carey et al. | 44/418 |

FOREIGN PATENT DOCUMENTS

| | | |
|---|---|---|
| 476 196 A1 | 3/1992 | European Pat. Off. . |
| 608 041 A1 | 7/1994 | European Pat. Off. . |
| 632 123 A1 | 1/1995 | European Pat. Off. . |
| 1565627 | 4/1980 | United Kingdom . |
| WO 85/01513 | 4/1985 | WIPO . |

*Primary Examiner*—John Kwon
*Attorney, Agent, or Firm*—Michael F. Esposito

[57] ABSTRACT

This invention relates to a process for reducing liner lacquering in a marine diesel engine operating on a marine diesel fuel having a temperature for a 90% volume recovery during distillation greater than 420° C. and an aromatics content greater than 25%, a saturates content less than 60% and an olefins content less than 3%, and being of a quality capable of giving rise to liner lacquering. The process comprises adding to the fuel a liner lacquering reducing amount of a fuel-soluble composition comprising: (A) at least one diesel detergent; and (B) at least one cetane improver. The invention also relates to marine diesel fuels containing components (A) and (B).

5 Claims, No Drawings

PROCESS FOR REDUCING LINER LACQUERING IN A MARINE DIESEL ENGINE AND FUEL THEREFOR

The present invention relates in general to marine diesel engines, typically four-stroke medium speed diesel engines, and to fuels therefor. In particular the present invention relates to a process for reducing liner lacquering in a marine diesel engine operating on a fuel capable of giving rise thereto.

A problem recently observed in connection with marine diesel engines, such as those powering Dutch fishing vessels, is that of liner lacquering whereby a hard resin-like material forms on cylinder liners and fills the honing grooves. This problem manifests itself in increased lubricating oil consumption which incurs a financial penalty. A solution to the problem, namely replacing the cylinder liners at regular intervals, also carries a financial penalty in that the vessel is temporarily out of commission during replacement of the liners in addition to the cost of replacement itself.

Initially it was thought that the problem was caused by deficiencies in engine design. Later the problem was ascribed to poor lubricating oil quality. The working pattern of the engine and the loads thereon were also thought to be contributory factors. However, a recent paper presented at the 20th International Congress of Combustion Engines, London, 1993, entitled 'The Influence of Marine Fuel Quality On Lubricating Oil Performance' by R W Allen of Castrol International Marine presents a strong case for deteriorating marine diesel fuel quality being a major factor together with engine overloading in the occurrence of the problem. The paper makes the observation that gas oil sold into the marine market is in general of lower quality (low sulphur, higher boiling ranges and aromatics content) and cost than that sold for inland applications and concludes realistically that even though this type of fuel may be associated with the formation of liner lacquers in overloaded engines it will continue to be produced and sold because of its lower cost. In relation to the problem of liner lacquering the paper ends with a question that remains to be answered, namely that if engine loading and low fuel quality are responsible for lacquer formation then why is it not a phenomenon in engines burning heavier fuels?

Whatever the origins of the problem we have now found that a solution to the problem is to incorporate into the marine diesel fuel certain additives, which though conventionally employed in automobile diesel engines, are not components of marine diesel fuels.

Accordingly in one aspect the present invention provides a process for reducing liner lacquering in a marine diesel engine operating on a marine diesel fuel of a quality capable of giving rise to liner lacquering which process comprises adding to the fuel a liner lacquering reducing amount of a fuel-soluble composition comprising:

(A) at least one diesel detergent, and (B) at least one cetane improver.

Marine diesel engines which are prone to liner lacquering problems are generally four stroke engines running on gas oils and to a lesser extent two stroke crosshead engines.

Marine diesel fuels of a quality capable of giving rise to liner lacquering are generally those having a high, typically greater than 340° C., for example greater than 360° C., preferably greater than 420° C., temperature for a 90% volume recovery during distillation and a high, ie greater than 25%, particularly greater than 35%, aromatics content. Generally this is accompanied by a low saturates content (less than 60%) and a low olefins content (less than 3%). The cetane number of such fuels is also generally about 40, or less. In addition, marine diesel fuels of a quality capable of giving rise to liner lacquering are generally those of a low sulphur content for example less than 2%, preferably less than 0.5%, more preferably less than 0.2% w/w.

The fuel-soluble composition added to the fuel comprises (A) at least one diesel detergent, and (B) at least one cetane improver. As regards the diesel detergent (A), these are materials which function to prevent the build-up of deposits in inter alia the injection system, particularly the injector nozzle, of a diesel engine which can adversely affect both the fuel flow and fuel atomisation characteristics of the injector. The term 'diesel detergent' includes all those materials which would be suitable for use in diesel engines and which have detergent action, generally classified as dispersants which have detergency action. Detergency in diesel engines is generally associated with a range of amine type detergents and polymeric dispersants typified by the following compounds: amines, imidazolines, amides, fatty acid succinimides, polyalkylene succinimides, polyalkylene amines and polyether amines. Preferred detergents are (i) oil-soluble amides or imides of long-chain hydrocarbyl-substituted mono- or dicarboxylic acids or their anhydrides and (ii) long-chain hydrocarbons having a polyamine attached directly thereto. A preferred detergent is an imide or amide formed by the reaction of a polyalkene substituted succinic acylating agent and an amine.

Succinimides are a well-known class of detergent. Typical of the art relating to such materials is GB-A-1565627 and the prior art acknowledged therein. Typically, they are prepared by reacting a polyalkene, in the presence or absence of chlorine, with either maleic acid, or preferably maleic anhydride, to produce a polyalkene-substituted succinic acid or anhydride and thereafter reacting the polyalkene-substituted succinic acid or anhydride with a nitrogenous material, suitably an amine, which may be a mono-, di- or polyamine.

A suitable succinimide has the formula:

(I)

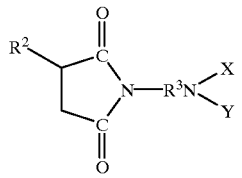

wherein $R^2$ is a hydrocarbyl group, typically a polyolefin group, preferably containing between 30 and 300 carbon atoms, more preferably between 50 and 150 carbon atoms; $R^3$ is a divalent group such that $H_2NR^3NXY$ is an alkylene amine, such as an ethylene or propylene amine, for example $R^3$ is $—(CH_2CH_2NH)_kCH_2CH_2$ wherein k is zero or an integer from 1 to 7, preferably 2 to 6, or a mixed ethylene/propylene amine, for example $H_2N(CH_2)_3NH(CH_2)_2NH(CH_2)_3NH_2$; and X and Y are independently either hydrogen, alkyl, or hydroxy alkyl, each of 1–6 carbon atoms, eg methyl, ethyl or hydroxyethyl, or together form the group:

(II)

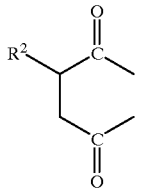

Alternatively, $R^3$ in the formula (I) may be a divalent group such that $H_2NR^3NXY$ is an alkanolamine or a polyether amine. Typically such alkanolamines may contain the group $=N.CH_2CH_2NH.CH_2CH_2OH$ (ie $R^3=CH_2CH_2$; X=H; $Y=CH_2CH_2OH$) and typically such polyether amines may contain the group $=NCH_2CH_2OCH_2CH_2.OCH_2CH_2NH_2$ (ie $R^3=(CH_2CH_2O)_2CH_2CH_2$; X=Y=H). Useful commercially available polyether amines are the Jeffamines (RTM) marketed by Texaco. $R^3$ is preferably an alkylene group, eg of 2 to 40 carbon atoms, optionally interrupted with at least one —O— or =NH group and in particular contains one or more units of alkylene oxa or alkylene amino groups, each of 2–4 carbon atoms.

$R^3$ may also be a divalent group such that $H_2NR^3NXY$ is an aromatic or araliphatic amine, eg of 6–20 carbon atoms, such as phenylene or biphenylene diamine or bis(amino benzyl).

Suitably in the formula (I) $R^2$ is derived from either ethylene, propylene, 1-butene, isobutene, 1-hexene, 1-octene, and the like. Alternatively, the polyalkene may be derived from an internal olefin, eg 2-butene, or an interpolymer, eg an ethylene/propylene copolymer. Preferably the polyalkene is a polyisobutene.

The succinimide may be either a mono- or a bis-succinimide.

Diesel detergents are marketed in various additive packages marketed by several additive manufacturers. In general the additive packages available appear to be based on compounds which can be classified as polymeric dispersants. The high viscosity of these compounds generally dictates that they are distributed in diluted form, typically 50% or more of an aromatic kerosene diluent being used. Any of the commercially available detergents may be employed.

The amount of detergent employed may be sufficient to provide up to 1000 ppm, for example up to 500 ppm, typically up to 250 ppm in the fuel, for example 100 to 200 ppm.

As regards the cetane improver (B), these are materials which promote fast oxidation of fuels and thus improve their ignition characteristics. Typical cetane improvers include the alkyl nitrates, ether nitrates, dinitrates of polyethylene glycols and certain peroxides. In general, however, in view of their low cost and ease of handling, primary alkyl nitrates are preferred. Examples of suitable cetane improvers useful in the performance of the invention include iso-propyl nitrate, iso-amyl nitrate, iso-hexyl nitrate, cyclohexyl nitrate and iso-octyl nitrate. A preferred cetane improver is iso-octyl nitrate. Desirably the cetane improver should increase the cetane number of the fuel to about 45, or greater.

As a supplement to adding a cetane improver of the aforesaid type the cetane number of the fuel may be increased by the addition of a hydrocarbon fraction known to be beneficial to ignition quality, for example a paraffinic hydrocarbon fraction.

In addition to the components (A) and (B) the fuel-soluble composition preferably incorporates as component (C) a demulsifier for fuel-water emulsions.

Any of the commercially available demulsifiers may be employed, suitably in an amount sufficient to provide a treat level of from 5 to 50 ppm in the fuel. A class of suitable demulsifiers are the quaternary amine salts. Other suitable demulsifiers include alkoxylated polyglycols and arylsulphonates.

The fuel-soluble composition preferably further incorporates as component (D) an antioxidant. Antioxidants are useful for inhibiting gum formation during fuel storage. Diesel antioxidants in current use are mainly based on hindered phenol or amine, for example phenylenediamines, structures. Any of the commercially available diesel antioxidants may be employed, suitably in an amount sufficient to provide a dose rate of from 2 to 200 ppm in the fuel.

The fuel-soluble composition may also suitably incorporate a liquid carrier for the components (A) and (B) and optionally (C) and/or (D). Suitable carriers include liquid hydrocarbons, for example kerosene. Alternatively, diesel fuel itself may be used as a carrier.

Additives such as antifoams, for example polysilicone based compounds, corrosion inhibitors, for example carboxylic acids, amines, amides and amine salts of carboxylic acids, wax crystal modifiers/distillate flow improvers, etc., may be incorporated if desired.

The fuel-soluble composition may be incorporated into the fuel during its manufacture.

Alternatively the composition may be blended into additive-free fuel contained in the fuel storage tanks of individual vessels.

In another aspect the present invention provides a marine diesel fuel composition suitable for use in a marine diesel engine which composition comprises a marine diesel fuel of a quality capable of giving rise to liner lacquering and a liner lacquering reducing amount of a fuel-soluble composition as hereinbefore described.

The invention will now be further illustrated by reference to the following Example.

EXAMPLE

The lubricating oil consumption of a KH Deutz medium speed diesel engine used to power a fishing vessel in Holland burning an additive-free diesel fuel was monitored weekly over a period of 73 weeks during which the weekly average consumption increased from about 0.65 to about 1.15 g/bhp hour (0.965 g/KW hour). Such a high consumption was consistent with severe liner lacquering. Normal expectation for oil consumption after this period of running would be approximately 0.8 g/bhp hour.

From week 73 on a weekly basis there was added to the bunker containing 30–34 t gasoil meeting the specification ISO 8217/Fuel DMA, ie sufficient to fuel the vessel for one week, a package comprising a polyisobutene mono-succinimide as detergent, and a commercially available cetane improver. The package was dosed such that the fuel contained 500 ppm of cetane improver and 100 ppm of detergent.

After week 88 the oil consumption had fallen from 1. 15 to 0.72g/bhp hour and endoscopic inspections during this period revealed almost complete removal of liner lacquer.

We claim:

1. A process for reducing liner lacquering in a marine diesel engine operating on a marine diesel fuel, said marine diesel fuel comprising a diesel fuel having a temperature for a 90% volume recovery during distillation greater than 420° C. and an aromatics content greater than 25%, a saturates content less than 60% and an olefins content less than 3%, and being of a quality capable of giving rise to liner lacquering which process comprises adding to the fuel a liner lacquering reducing amount of a fuel-soluble composition comprising:

(A) at least one diesel detergent selected from the group consisting (i) oil-soluble amides or imides of long-chain hydrocarbyl-substituted mono- or dicarboxylic acids or their anhydrides, and (ii) long-chain hydrocarbons having a polyamine attached directly thereto, and (B) at least one cetane improver selected from the group consisting of alkyl nitrates, ether nitrates, dinitrates of polyethylene glycol, and dinitrates of peroxides.

2. A process according to claim 1 wherein the fuel-soluble composition additionally incorporates as component (C) a demulsifier for fuel-water emulsions.

3. A process according to claim 1 wherein the fuel-soluble composition additionally incorporates as component (D) an antioxidant.

4. A process according to claim 1 wherein the fuel-soluble composition further comprises a liquid carrier for the components (A) and (B).

5. A marine diesel fuel composition suitable for use in a marine diesel engine which composition comprises a marine diesel fuel having a temperature for a 90% volume recovery during distillation greater than 420° C. and an aromatics content greater than 25%, a saturates content less than 60% and an olefins content less than 3%, and being of a quality capable of giving rise to liner lacquering and a liner lacquering reducing amount of a fuel-soluble composition comprising:

(A) at least one diesel detergent selected from the group consisting (i) oil-soluble amides or imides of long-chain hydrocarbyl-substituted mono- or dicarboxylic acids or their anhydrides, and (ii) long-chain hydorcarbons having a polyamine attached directly thereto; and (B) at least one cetane improver selected from the group consisting of alkyl nitrates, ether nitrates, dinitrates of polyethylene glycol and dinitrates of peroxides.

* * * * *